United States Patent [19]

Offutt, III

[11] 4,092,000

[45] May 30, 1978

[54] EXTENSION SPRAY DEVICE

[76] Inventor: Harry C. Offutt, III, 969A Beachland Blvd., Vero Beach, Fla. 32960

[21] Appl. No.: 743,947

[22] Filed: Nov. 22, 1976

[51] Int. Cl.[2] ..... B05B 15/06

[52] U.S. Cl. ..... 239/532; 222/174; 239/578; 251/294

[58] Field of Search ..... 239/274, 375, 525, 526, 239/532, 579, 578; 222/174, 402.15, 473, 474; 251/294; 74/110

[56] References Cited

U.S. PATENT DOCUMENTS

| | | | |
|---|---|---|---|
| 2,887,272 | 5/1959 | Rosenthal | 222/402.15 X |
| 2,893,606 | 7/1959 | Hawkins | 222/174 |
| 3,143,254 | 8/1964 | Vanderhyde | 222/402.15 X |

*Primary Examiner*—Robert R. Song
*Assistant Examiner*—Michael Mar
*Attorney, Agent, or Firm*—Carroll F. Palmer

[57] ABSTRACT

An extension spray device for aerosol cans having a crimped-cap closure comprises a can holder that grips the periphery of the closure cap, a spray member to engage the can control valve stem and convey fluid from the can to a lateral spray nozzle, an extension tube connecting a remote handle to the aerosol can holder, a wedge to force the spray member against the valve stem to dispense fluid from the can and a line attached to the wedge carried within the extension tube to move the wedge from the handle. The extension tube connection to the can holder can be moveable so that the spray can angle can be varied relative to the extension tube and handle.

9 Claims, 7 Drawing Figures

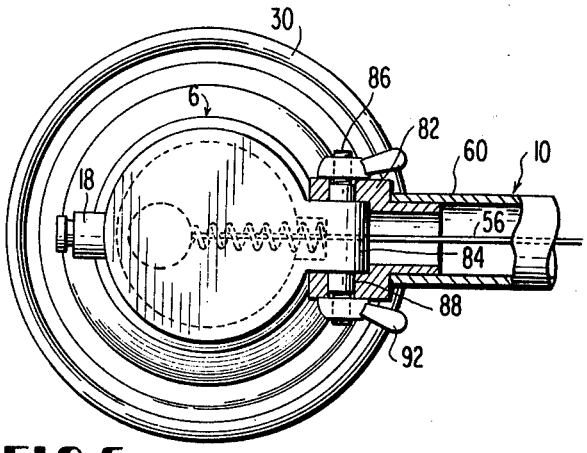
FIG. 5
FIG. 3
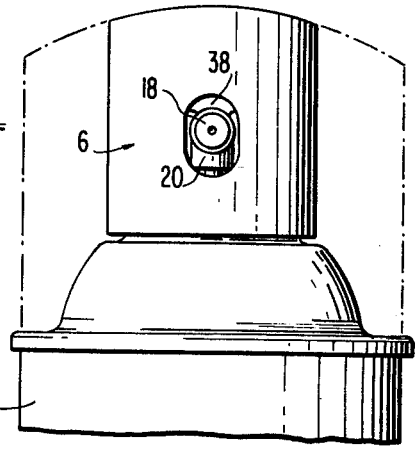
FIG. 6
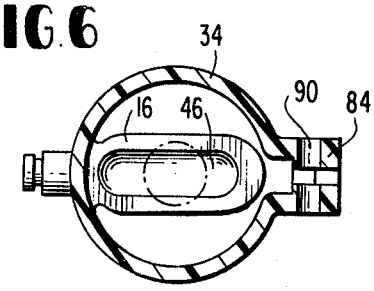
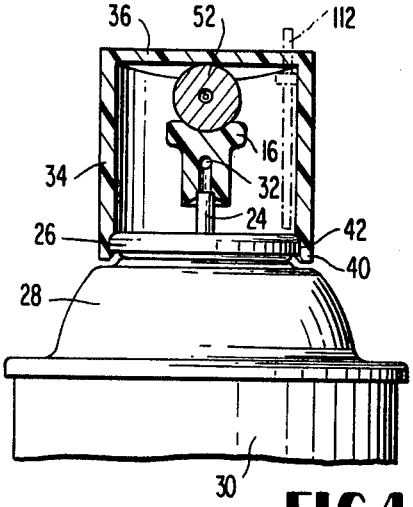
FIG. 4
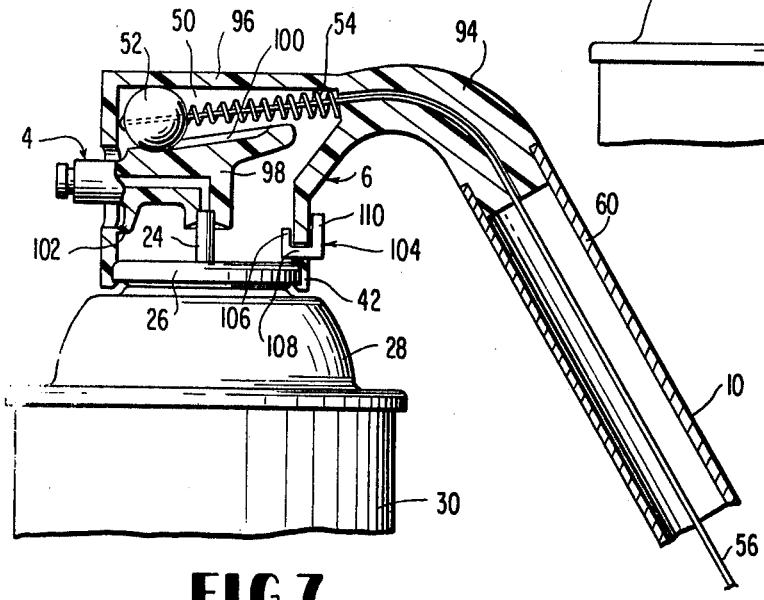
FIG. 7

EXTENSION SPRAY DEVICE

BACKGROUND OF THE INVENTION

1. Field of the Invention

This invention relates broadly to extension spray devices. More particularly, it concerns such devices that remotely support and operate conventional aerosol spray cans having a crimped-cap closure and a moveable control valve stem extending from the closure.

2. Description of the Prior Art

Aerosol dispenser cans popularly called "spray cans", are widely used for spraying many different types of compositions on to various substrates. Frequently, it is desireable to apply the sprayed material on a surface that is not conveniently reached with the spray can held in the hand of the user, e.g., spraying paint on a ceiling or spraying insecticide along a baseboard. Such situations make it desireable to have a device in the nature of an extension arm to which the spray can may be attached and operated by the user located remotely from the spray nozzle.

Extension tools for remotely supporting and operating aerosol cans have been developed and patented (see U.S. Pat. No. 3,229,859; 3,716,195 and 3,861,566). These prior art devices involve various methods for fastening the spray can to the extension tool and for actuating its control valve.

Various other arrangements have been developed and disclosed for actuating the control valve and hold the can (see U.S. Pat. No. 3,045,878; 3,066,838 and 3,318,493). Some of the prior devices have used can holding arrangements that clamp or grip the spray can only around the periphery of the crimped-cup closure for the can (see U.S. Pat. Nos. 2,960,260 and 3,112,849).

Notwithstanding these prior developments on extension spray devices, the use of aerosol spray cans could be further advanced by additional improvements in spray extension devices that would provide advantages in operation, ease of can attachment, and detachment, in handling or the like.

OBJECTS

A principal object of the present invention is the provision of new improvements in extension spray devices capable of remotely supporting and operating conventional aerosol spray cans.

Another object is the provision of such devices to which a spray can can be attached or removed with little effort and in a minimum of time, but from which the can will not accidentally detach during use.

A further object is the provision of such devices which utilize an uncomplicated but highly effective remote control arrangement for operating the control valve of the can.

Other objects and further scope of applicability of the present invention will become apparent from the detailed description given hereinafter; it should be understood, however, that the detailed description, while indicating preferred embodiments of the invention, is given by way if illustration only, since various changes and modifications within the spirit and scope of the invention will become apparent to those skilled in the art from this detailed description.

SUMMARY OF THE INVENTION

These objects are accomplished according to the present invention by an extension spray device for remotely supporting and operating a conventional aerosol can having a crimped-cap closure with a moveable tubular control valve stem extending centrally out from the closure which comprises:

Can holding means having gripper means to fasten the spray device to said aerosol can by gripping the periphery of the crimped-cap closure.

a spray member having a spray nozzle extending laterally of said can holding means, a coupling portion to engage said valve stem and a bore connecting said coupling portion to said spray nozzle for fluid flow from said valve stem to said spray nozzle.

an extension tube connected to one end to said can holding means, a handle on the other end of said extension tube, wedge means to force said spray member coupling portion against said valve stem to release fluid from the aerosol can and a line carried within said extension tube to move said wedge means by force applied at said handle.

In a preferred form of the new spray devices, the wedge means to operate the control valve of the spray can comprises a longitudinal groove in the spray member, an opposed surface, a wedge-shaped space between the surface and the groove and a spring-biased ball that moves in the groove and is forced against it by the opposed surface.

BRIEF DESCRIPTION OF THE DRAWINGS

A more complete understanding of the new extension spray devices of the invention can be had by reference to the attached drawing in which:

FIG. 3 is a front end view of the spray device of FIG. 1.

FIG. 4 is a sectional end view taken on the line IV—IV of FIG. 2.

FIG. 5 is a fragmentary plan view, partially in section, of a modified form of spray device of the invention.

FIG. 6 is a sectional view of a portion of the spray device of FIG. 5.

FIG. 7 is a lateral, fragmentary view partially in section, of another form of spray device of the invention.

DESCRIPTION OF THE PREFERRED EMBODIMENTS

Figure 1:
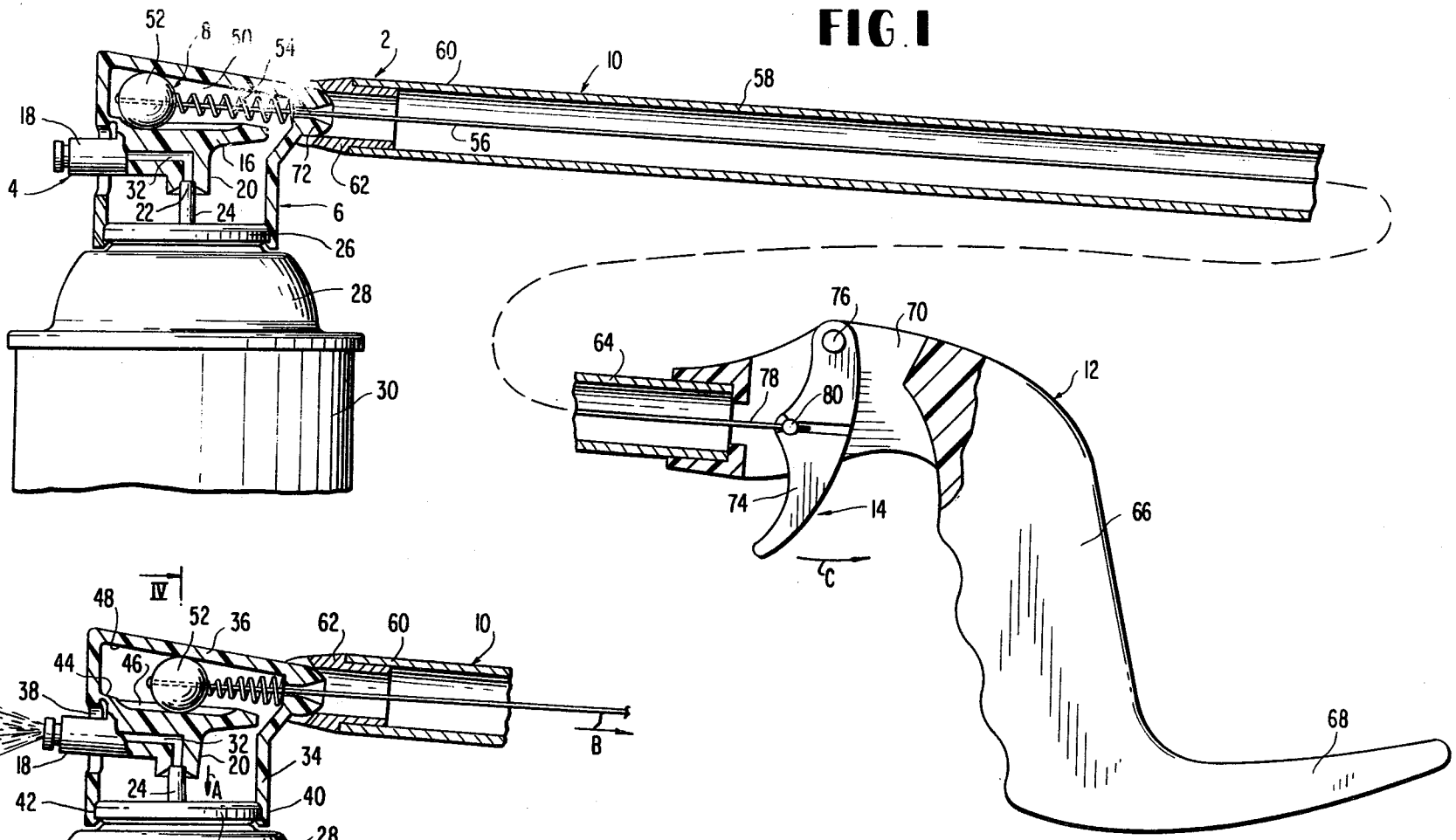
FIG. 1 is a fragmented, lateral view partially in section, of an extension spray device constructed in accordance with the invention.

Referring in detail to the drawings, the extension spray device 2 comprises a spray member 4, can holding means 6, valve stem actuation means 8, tubular extension 10, handle 12 and lever means 14.

The spray member 4 has a profiled body portion 16, a spray nozzle 18 extending laterally therefrom, a dished coupling 20 depending from the body portion 16 to engage the end 22 of the tubular control valve stem 24 which extends centrally out from the cap closure 26 crimped to the domed head 28 of the spray can 30.

An L-shaped bore 32 joins the nozzle 18 to the coupling 20 for flow of fluid from the end 22 of the valve stem 24 upon actuation of the control valve (not shown) of the spray can 30. The control valve and valve stem are of conventional form and the valve is actuated for dispensing fluid from the spray can, as is well known to users of such spray cans, by depressing the valve stem 24.

The can holding mean 6 is formed by a cylindrical member 34, a transverse web portion 36 and a lateral opening 38 in the member 34 through which the spray nozzle 18 extends. The transverse web portion 36 in the embodiment shown in FIGS. 1–4 closes the top end of the cylindrical member 34. The bottom end 40 is open and is provided with gripper means to grip the crimped-cap closure 26 consisting of an annular groove 42 on the inside of the end 40 sized to embrace the periphery of the closure 26.

A hinge 44 adjacent the lateral opening 38 connects the spray member body portion 16 to the cylindrical member 34 holding the nozzle 18 in position to discharge through the lateral opening 38. The hinge 44 permits the spray member to move in the direction of the arrow A in FIG. 2 as will be explained further hereafter in order to operate the spray device.

Preferrably, the spray member 4 and can holding member 6 together with hinge 44 are all molded as an integral unit from plastic material, e.g., high density polyethylene, polypropylene or comparable thermoplastic material. However, these items may be separately formed of plastic, metal or the like and assembled, e.g., by spot welding the members 4 and 6 together with the hinge 44. Alternatively, and particularly where the member 4 and 6 are molded as an integral unit from plastic material, there may be provided as an additional element an integral cylindrical member as shown in phantom line in FIG. 3 providing a canopy arrangement generally coextensive with the walls of the spray can 30.

The means used to grip the closure 26, instead of being an annular groove 42 as shown can be a series of small lugs extending radially inwardly from the inside wall of the cylindrical member 34. Alternate structures for gripping the periphery of a crimped-cap closure are possible to be used in place of the groove arragement as illustrated, e.g., see U.S. Pat. Nos. 2,960,260 and 3,112,849.

The valve stem actuation means 8 comprises a groove 46 in the body portion 16 opposed to the coupling 20. The distance between the base of the groove 46 and the undersurface 48 of the transverse web portion 36 progressively decreases rearwardly from the nozzle 18 creating a wedge-shaped space 50 between the groove 46 and the undersurface 48. In the embodiment shown in FIGS. 1 and 2, the wedge-shaped space 50 is created by downward sloping of the web 36 while the groove 46 runs approximately parallel to the top surface of the closure 26. Alternatively in the embodiment shown in FIG. 7, the web is flat and the groove angled upwardly as will be described further hereafter.

A wedge member in the form of a ball 52 is positioned in the groove 46. It is of such size as to engage both the groove and the undersurface 48 of the widest part of the space 50. The ball is biased in this position by the coil spring 54. A line 56 is fixed to the ball 52 to permit the ball to be pulled in the direction of the arrow B of FIG. 2.

The tubular extension 10 comprises a tube provided at the distal end 60 with a socket member 62. The proximal end 64 is fastened to the handle 12 which includes the pistol grip 66, hand brace portion 68 and lateral portion 70. The member 6 is provided with an integral ball joint element 72 which together with the molded socket member 62 provides a flexible joint between the tubular extension 10 and member 6 permitting the angle between the spray axis of nozzle 18 and the longitudinal axis of the tubular extension to be varied. Such movement of the member 6 relative to extension 10 enables the user of the device 2 to accomodate the device to different structural conditions that might be encountered in the variety of applications to which the device might be put.

The lever means 14 comprises a trigger 74 pivoted on pin 76 carried on the handle portion 70. The proximal end 78 of the line 56 is connected to the trigger 74 by the swaged ball 80 so that movement of the trigger in the direction of the arrow C of FIG. 1 moves the wedge ball 52 in the direction of arrow B and the coupling 20 in the direction of arrow A of FIG. 2 thereby opening the control valve of spray can 30 to dispense fluid to the nozzle 18.

An alternative arrangement for flexible connection between the members 6 and 10 is illustrated in FIGS. 5 and 6. Here, a yoke 82 is fixed to the distal end 60 of member 10 and embraces the lug 84 integrally formed to the cylindrical member 34. A double-ended bolt 86 extends through the bore 88 of yoke 82 and bore 90 of lug 84. Wing-nuts 92 are threaded on the bolt 86 permitting the yoke 82 to be compressed on the lug 84 to fix the position of member 10 relative to member 6.

Figure 2:
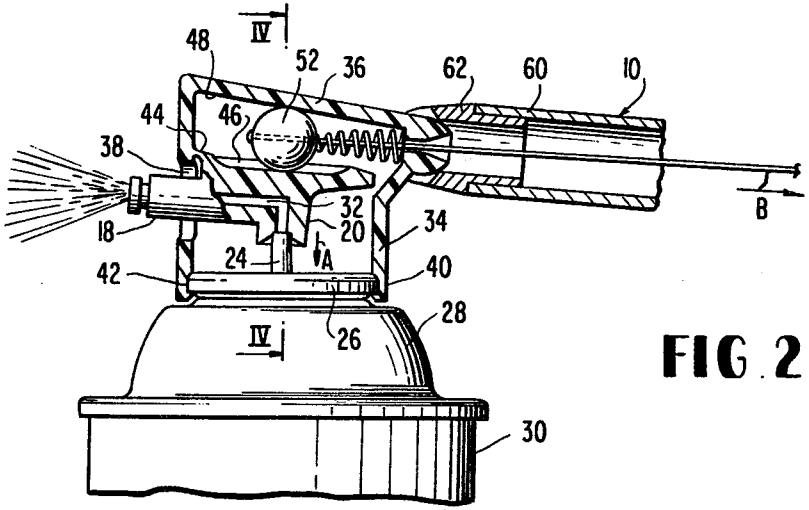
FIG. 2 is a fragmentary lateral view, partially in section, showing the device of FIG. 1 with the spray control valve actuated.

The embodiment of FIG. 7 comprises a fixed position of the member 10 relative to the member 6. Thus, the distal end 60 of member 10 is fixed to the goose-neck 94 molded as an integral portion on the member 6. In this embodiment, the web portion 96 of member 6 is substantially parallel to the top edge of the closure cap 26 and the body portion 98 of member 6 is formed so that the groove 100 slopes upwardly from the closure 26. This provides an alternate arrangement to define a wedge-shaped space in which the ball wedge 52 will operate. The body portion 98 of member 4 is fixed to the member 6 by the hinge 102 differently located as regards the hinge 44 as shown in FIGS. 1 and 2.

The connection between the spray can 30 and the spray device 2 provided by the gripper means comprising groove 42 is fully adequate to maintain the can on the extension spray device. It may be desirable, once the can has been attached to the device to separate the two, e.g., for storage purposes, to spray without the extension, to replace an empty can with a refill, etc. The connection of the can to the device may be so strong that this may be extremely difficult. The new devices 3 may, therefor, be provided with separation assistance means 104. Such means may take various forms. As seen in FIG. 7, the means 104 may comprise an inner cam 106 attached by a shaft 108 to the external lever 110. Movement of the lever 110 in a direction perpendicular to the plane of the drawing will cause the cam 106 to push against the closure 26. This will break the "seal" between the periphery of the closure 26 and groove 42 whereby the can can then be easily disengaged from the device 2. Alternatively, the means 104 can be a push-rod 112 as shown in phantom line in FIG. 4. Also, a removable key (not shown) may be used in place of the shaft 108 and lever 110 to operate cam 106.

The new extension spray devices as described although simple in construction and inexpense to manufacture are easy to use. They permit aerosol spray cans to be efficiently used to apply sprayed material to surfaces that would be difficult, or even impossible, to reach by holding the spray can in the hand of the user. The new extension devices can also serve to protect the user against inhaling sprayed materials or involving the user with other hazards, e.g., bees or wasps, during the use of aerosol spray cans for certain applications.

The embodiments of the invention in which an exclusive property or privilege is claimed are defined as follows:

1. An extension spray device for remotely supporting and operating a conventional aerosol can having a crimped-cap closure with a moveable tubular control valve stem extending centrally out from said closure which comprises:

a spray member comprising a body portion
a nozzle extending laterally therefrom,
a dished coupling depending from said body portion, and
an L-shaped bore in the body portion joining said nozzle to said coupling;
can holding means comprising:
a cylindrical member,
a transverse web portion at one end of the cylindrical member,
the opposite end thereof having gripper means to grip the crimped-cap closure of an aerosol can,
a lateral opening in said cylindrical member, and
a hinge adjacent said lateral opening connecting said spray member body portion to said cylindrical member holding said nozzle in position to discharge through said lateral opening,
valve stem actuation means comprising:
a groove in the surface of said spray member body portion opposite to said dished coupling, the distance between the base of said groove and the undersurface of said transverse web portion of said can holding means progressively decreasing rearwardly of said nozzle,
a wedge member positioned in said groove and engaging said undersurface,
spring means biasing said wedge member toward said nozzle, and
a line fastened to said wedge member by which it may be pulled along said groove away from said nozzle;
a tubular extension having first and second ends connected at its first end to said can holding means, said actuating means line extending along said extension member internally thereof,
a handle attached to the second end of said extension member, and
lever means carried by said handle connected to said line to enable said wedge member to be moved by movement of said lever means.

2. The spray device of claim 1 wherein said wedge member is a ball.

3. The spray device of claim 1 wherein the connection between said tubular extension and said can holding means is adjustable permitting the angle between the longitudinal axis of the tubular extension and the spray axis of said nozzle to be altered.

4. The spray device of claim 1 having means to assist in disengagement of said gripper means from said crimped-cap closure.

5. The spray device of claim 4 wherein said disengagement means is a push-rod.

6. The spray device of claim 4 wherein said disengagement means is a cam member.

7. The spray device of claim 1 wherein said spray member and said can holding means are an integral unit molded of plastic material.

8. The spray device of claim 1 wherein said handle is of pistol-grip form and said lever means is of trigger form.

9. In an extension spray device for remotely supporting and operating a conventional aerosol can having a crimped-cap closure with a moveable tubular control valve stem extending centrally out from said closure the improvement which comprises:

can holding means having gripper means to fasten the spray device to said aerosol can by gripping the periphery of the crimped-cap closure,
a spray member having a spray nozzle extending laterally of said can holding means, a coupling portion to engage said valve stem and a bore connecting said coupling portion to said spray nozzle for fluid from said valve stem to said spray nozzle,
an extension tube connected at one end to said can holding means,
a handle on the other end of said extension tube,
a ball to force said spray member coupling portion against said valve stem to release fluid from the aerosol can and
a line carried within said extension tube to move said ball by force applied at said handle,
a longitudinal groove in said spray member opposed to said coupling portion,
a surface opposed to said groove defining a wedge-shaped space between said surface and groove
said ball being carried in said space, said ball being fastened to said line, and
spring means biasing said ball toward the widest portion of said space.

* * * * *